United States Patent [19]

Day et al.

[11] 4,296,917

[45] Oct. 27, 1981

[54] CONTOURED CABLE ROLLER

[75] Inventors: Ralph R. Day, Aurora; B. James Wulff, Montgomery, both of Ill.

[73] Assignee: Caterpillar Tractor Co., Peoria, Ill.

[21] Appl. No.: 137,068

[22] Filed: Apr. 3, 1980

[51] Int. Cl.[3] ..... B66D 1/36

[52] U.S. Cl. ..... 254/400; 254/327

[58] Field of Search ..... 254/390, 394, 400, 327, 254/325, 336, 326, 280, 281, 285, 286; 212/167; 414/506, 539, 559, 569; 226/189; 242/157 R

[56] References Cited

U.S. PATENT DOCUMENTS

| | | | |
|---|---|---|---|
| 2,292,882 | 8/1942 | Langdon | 254/325 |
| 3,498,488 | 3/1970 | Wildey et al. | 254/327 |
| 3,515,297 | 6/1970 | Symons | 254/326 |
| 3,576,266 | 4/1971 | Wildey | 212/167 |
| 3,739,928 | 6/1973 | Randall | 254/400 |
| 3,830,507 | 8/1974 | Johnson . | |
| 3,976,210 | 8/1976 | Allen | 414/559 |

FOREIGN PATENT DOCUMENTS

| | | | |
|---|---|---|---|
| 265919 | 7/1963 | Australia | 254/400 |

*Primary Examiner*—John M. Jillions

*Attorney, Agent, or Firm*—Wegner, Stellman, McCord, Wiles & Wood

[57] ABSTRACT

A log skidder (10) has a fairlead (26) with a main guide roller (54) having a special contoured surface (60) to prevent grooving of the surface of the guide roller (54), to prolong cable life, and to assist in evenly winding the cable (32) on a winch drum (33). The special contoured surface (60) of the guide roller (54) includes a pair of shaped or rounded shoulders (68) at the side extremes which are aligned with the side rollers (44,46) in a way that a cable (32) passing over the main guide roller (54) in contact with one of the side rollers (44,46) receives a downward and inward centering force component which moves the cable (32) toward the midportion of the main guide roller (54).

14 Claims, 3 Drawing Figures

FIG. 1
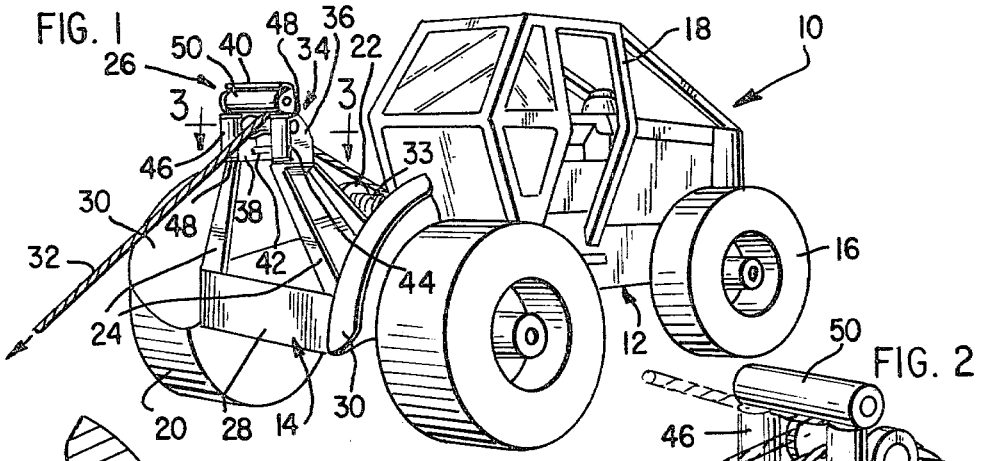
FIG. 2
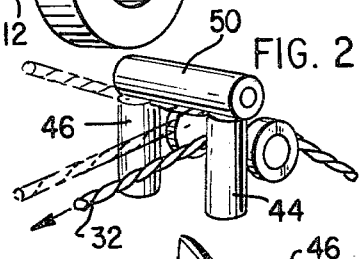
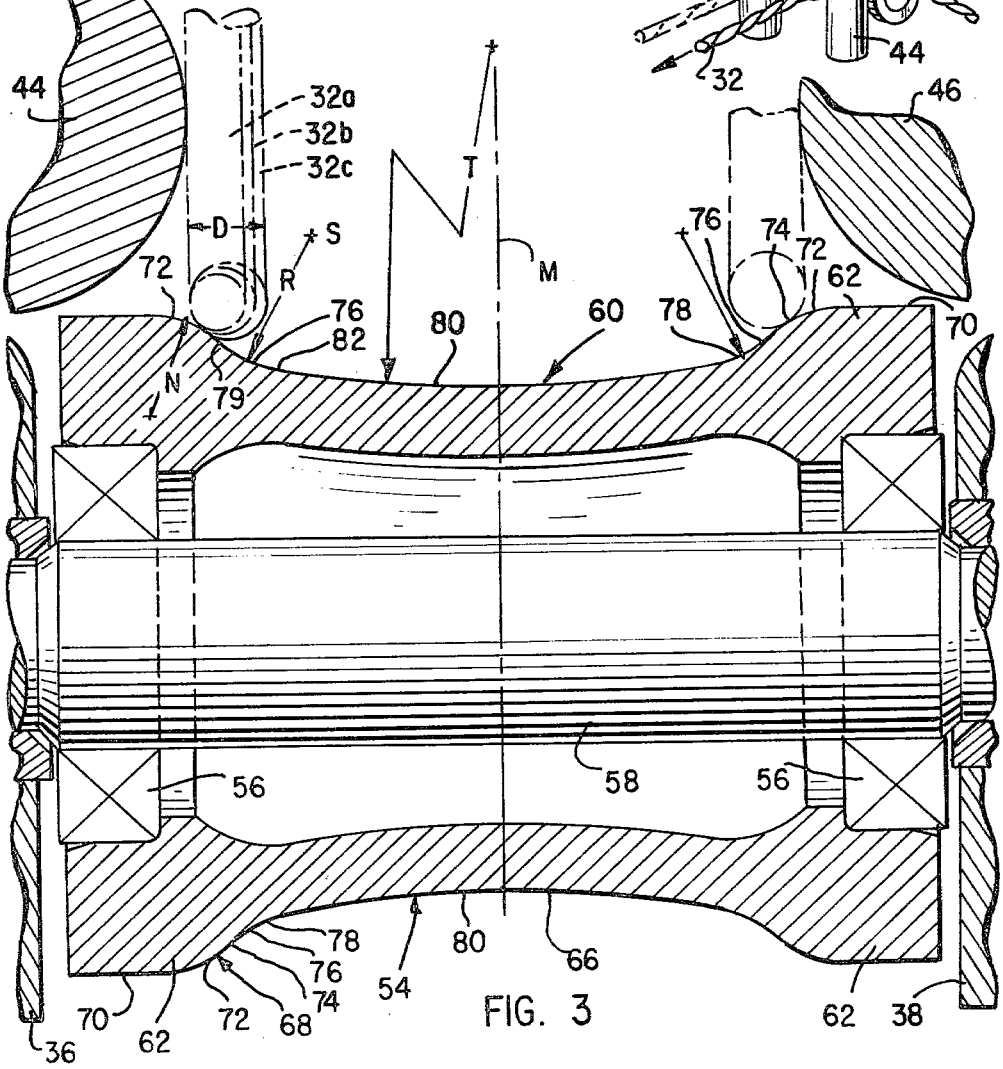
FIG. 3

CONTOURED CABLE ROLLER

DESCRIPTION

1. Technical Field

This invention relates to a fairlead for a log skidder and, more particularly, to a special contoured surface for a guide roller of the fairlead.

2. Background Art

Fairleads for log skidders are well known in the art and generally are mounted on support brackets of a logging frame on the rear frame portion of the skidder. In the early designs of fairleads, the main guide roller, over which a cable that was attached to a log, or the like, was drawn in as the towing winch pulled in the log, was cylindrical in shape having a substantially uniform diameter throughout its width. Using such a straight main guide roller, resulted in the cable continually rolling to one area of the roller causing the roller to become grooved after a considerable period of time. Once a groove is formed in the surface of the guide roller, turning or changing the direction of the skidder with respect to the log, causes the cable riding in the groove to come out of the groove fraying the cable on the sharp corner or edge of the groove. An additional problem with the uniform diameter main guide roller is that frequently the cable will roll or run on one side roller as it is led onto the main guide roller which causes wear on said side roller eventually requiring repair or replacement of the grooved and worn side roller. The uniform diameter main guide roller has a tendency to guide the cable onto the roller of the winding winch at one location. When the cable piles up enough, it will roll over and become tangled.

The straight surface or uniform diameter roller also will permit the cable to skid on the roller from one side of the roller to the other during a change in direction of the vehicle which will generate heat and smoke between the cable and roller and can cause fraying of the cable. At one point in time, a flange was provided on each side of the main guide roller to prevent the cable from running off the sides of the main roller.

One early patent showing a uniform diameter guide roller is the U.S. Pat. No. 2,292,882 to R. S. Langdon issued Aug. 11, 1942. The main guide roller of the fiarlead of the Langdon patent has a uniform diameter with side and top rollers defining the opening through which the cable passes as it is paid out or drawn in from the winch.

A second form of known prior art uses a concave curved surface on the guide roller which was intended to guide the cable away from the side rollers. The concave surface was generated by using gradually decreasing diameters for adjacent sections of the surface as the center of the roller was approached. This concave structure was an improvement over the straight or uniform diameter roller but still had the problem of guiding the cable to one central area of the surface (where the smallest diameter section was located) which resulted in grooving of the center surface of the roller and fraying of the cable when the cable was forced out of the groove. Typical showings of the uniformly concave curved guide roller are present in the U.S. Pat. No. 3,498,488 to A. J. Wildey at al issued Mar. 3, 1970, U.S. Pat. No. 3,515,297 to R. C. Symons issued June 2, 1970, and U.S. Pat. No. 3,576,266 to A. J. Widley issued Apr. 27, 1971. In each prior art showing, the curvature of the concave surface is pronounced toward the center forcing the cable into the center of the roller where it can run a groove therein after a period of use.

The present invention is directed to overcoming one or more of the problems as set forth above.

DISCLOSURE OF INVENTION

In one aspect of the present invention a fairlead for a log skidder is provided with an improved contoured surface of a main guide roller which has curved shoulders at each side portion of the main roller and has a uniformly concave or straight surface in the central portion thereof between said shoulders. The contoured shoulders guide the cable away from the side portions of the main guide roller and away from the side rollers. The cable is forced to travel over more of the contoured roller surface preventing the running of grooves into said roller surface and preventing excessive wear in only one portion of the surface. The shoulders of the contoured roller surface are located with respect to the side rollers in a manner that creates a downward and inward force on the cable moving the cable off the shoulders and away from the side rollers. The contoured roller surface helps to guide or spool the cable onto the roller of the winch in a uniform fashion that avoids tangling and knotting of the cable on the winch roller.

The contoured surface of the main guide roller has two small radii, oppositely directed curved surfaces on each side portion of the roller and has a large uniform radius surface on the central portion of the roller. The two oppositely directed curved surfaces of each side portion blend smoothly into each other and blend smoothly into the uniform radius surface of the central portion so as not to create any discontinuity therebetween upon which a cable can hang and subsequently wear a groove in the surface.

The contoured surface of the main roller urges the cable away from the location where it comes in tangent to a side roller by varying force components, causing the cable to position itself differently each time, spreading the wear area, and eliminating grooving in the central portion of the roller.

BRIEF DESCRIPTION OF DRAWINGS

FIG. 1 is a perspective view of a log skidder having a towing winch supporting a fairlead containing an improved main guide roller;

FIG. 2 is an enlarged perspective view, with parts broken away, of the fairlead and improved main guide roller of FIG. 1; and FIG. 3 is an enlarged cross-sectional view of the improved main guide roller taken along the line 3—3 of FIG. 1.

BEST MODE FOR CARRYING OUT THE INVENTION

Referring to FIGS. 1 and 2 of the drawings, a log skidder 10 is illustrated and comprises a front frame portion 12 articulated to a rear frame portion 14 through a connection, not shown. The front frame portion 12 is mounted on a pair of wheels 16 driven by a power plant, not shown, carried by said front frame. A cab 18 is positioned on the front frame portion 12 and encloses an operator station containing the usual seat and controls for operating the vehicle. The rear frame portion 14 is mounted on a pair of wheels 20 and has a power winch 22 driven either by a power take off from the power plant on the front frame portion 12, or by a hydraulic motor, or the like.

A support bracket 24 is anchored on the rear frame portion 14 between the wheels 20 and supports a fairlead 26 on the upper end thereof. A butt plate 28 having wrap around fenders 30 is secured to the rear frame portion 14 below and on either side of the support bracket 24. A cable 32 is wrapped around the drum 33 of the power winch 22 and extends through the fairlead 26 to a log, or the like, being skidded or maneuvered by the log skidder or vehicle 10.

The fairlead 26 is comprised of a housing 34 having spaced side walls 36,38, a top wall 40 and a bottom wall 42. The housing 34 is open at the front and at the rear. A pair of side rollers 44,46 are rotatably mounted about vertical axles, not shown, extending between brackets 48 carried by the side walls 36,38 of the housing 34. The side rollers 44, 46 extend in overlapping relationship to the side walls 36,38 so as to restrict the width of the opening into the housing 34 of the fairlead 26. An overhead roller 50 is rotatably mounted about a horizontal axle, not shown, extending between the side walls 36,38. When the direction of the cable 32 from the workload through the fairlead 26 is to the left, to the right, or downward, the cable 32 will roll either on the appropriate side roller 44,46, or on the overhead roller 50, all in substantially the manner known in the prior art.

As shown in FIG. 3, a main guide roller 54 is pivotally mounted on bearings 56 carried by an axle 58 extending between the side walls 36 and 38 of the housing 34. It is to be understood that the guide roller 54 could also be a one-piece solid structure, or the like, without departing from the spirit of the invention. The guide roller 54 has a contoured surface 60 containing two spaced apart side portions 62,62 and a central portion 66 between said side portions. Each side portion 62,62 has a shoulder 68 which is comprised of a longitudinally extending enlarged diameter raised section 70 having a substantially uniform diameter throughout. At the inner extremity of the enlarged section 70, a convex rounded section 72 is formed, with the surface 74 of said convex section 72 lying tangent to said enlarged section 70. Immediately contiguous to said convex rounded section 72 is a concave rounded section 76 having a surface 78 merging with the surface 74 of the convex rounded section 72.

The merger or transition 79 from the concave rounded section 76 to the convex rounded section 72 is continuous and smooth leaving no ridge or valley that would create a discontinuity on the contoured surface 60 of the roller 54. Immediately contiguous to the concave section 76 is the central portion 66 of the roller 54 which has a uniform concave contoured surface 80 with the edges of the concave contoured surface 80 lying tangent at the transition or merger point 82 to the surface 78 of the concave rounded sections 76 of the shoulders 68. The location of the transition or merger point 82 between the concave rounded section 76 and the concave contoured surface 80 should be at about a quarter point for a circle having a radius T. The radius T being the radius of curvature for the concave contoured surface 80. To locate the quarter point, which will correspond to the transition or merger point 82, the radius T lying parallel to the axis of the shaft or axle 58 is divided in half and the dividing point is moved parallel to the centerline M of the roller 54 until it intersects the concave contoured surface 80. At the point of intersection with surface 80 is the transition or merger point 82. The junction between the concave contoured surface 80 and the concave rounded sections 76 is smooth and continuous.

The location of the centers and the size of the radii of the convex rounded sections 72 and the concave rounded sections 76 is somewhat important and is determined in a unique manner. In FIG. 3, three different diameter cables **32*a*,32*b* and 32*c* are illustrated in dashed lines with the diameter of the largest cable 32*c* being designated as D. The concave rounded section 76 has a radius R with the center of the section 76** being designated S. It has been found that for a cable with maximum diameter D, the size of the radius R should be approximately twice the diameter D to give the best results.

In addition, the location of the transition or merger point 79 from the convex rounded section 72 to the concave rounded section 76 should be at or about a point on the roller surface which is at the intersection of a line lying parallel to the centerline M and drawn from the center of the largest diameter cable **32*c* (i.e. $\frac{1}{2}$ D) when the cable is against the side roller 44,46. The radius N of the convex rounded section 72 is selected to give the smooth transition or merger at point 79 as specified. This provides the proper departure angle in order to eliminate a notch effect at the juncture between the two merging oppositely directed sections. The convex rounded section 72 extends outwardly beyond the intersection of a plane with said main roller 54, which plane lies tangent to said rollers 44,46 and perpendicular to radii of said rollers 44,46, which radii are parallel to the axis of the main guide roller 54. Stated another way, the tangent between the convex rounded section 72 and the enlarged section 70 is outboard of said plane. As a result of the location of the convex rounded section 72 with respect to the side rollers 44, 46, the cable 32 will always contact the shoulders 68 on the downwardly curved portion of the shoulder 68 which will provide a downwardly and inwardly directed force on the cable 32, guiding the cable along the shoulder 68 to the concave rounded section 76 and then to the concave contoured surface 80 of the main roller. The guiding of the cable 32 down the surface 74,78 of the shoulder 68 will move the cable 32 away from contact with the adjacent side roller 44 or 46** thereby reducing wear on said side roller.

The radius T of the curved concave contoured surface 80 is relatively long. In practice, one operative device has a radius T equal to approximately eighteen inches, a radius R equal to approximately two inches, a radius n equal to approximately 1.5 inches, and a maximum cable diameter equal to approximately one inch.

INDUSTRIAL APPLICABILITY

A log skidder 10 with a fairlead 26 mounted on a bracket 24 has a cable 32 wound on a power winch 22. The free end of the cable 32 passes through the open front and rear of the housing 34 of the fairlead 26 and is connected to a log some distance away. The winch 22 is activated to draw the cable 32 over a main guide roller 54 in the fairlead 26 as the log is skidded along the ground toward the skidder 10. Assuming that the initial position of the log was to the left of the skidder 10, the cable 32 will enter the fairlead 26 by rolling on side roller 44 and on the shoulder 68 of the main roller 54 as the slack is taken up in the cable. As a pulling load is placed on the cable 32, a downwardly and inwardly directed force will be created on the cable due to the convex rounded section 72 of the shoulder 68. That is, the shape of the surface 74 of the convex rounded section 72 will not afford a holding surface for the cable and, due to the curvature of said rounded section 72, a resultant force toward the central portion 66 of the main roller 54 is produced. As the force moves the cable 32 down the shoulder 68 toward the center portion 66 of the main roller 54, the cable 32 will be moved away from the side roller 44. The cable 32 will move from the surface 74 of the convex rounded section 72 of the shoulder 68 to the surface 78 of the concave rounded section 76 where the resultant force is still toward the central portion 66 of the main roller 54. The uniformly concave contoured surface 80 of the central portion 66 of the main roller 54 will have a resultant force tending to urge the cable 32 toward the midsection of the central portion 66 but with a less amount of force than that afforded by the shoulder 68. The unique contoured surface 80 causes the cable 32 to travel over more of the roller surface thereby reducing wear on the overall surface thereof. The contoured surface 80 of the main guide roller 54 assists in uniformly winding the cable 32 onto the drum 33 of the winch 22. The shouldered contoured surface of the main guide roller 54 results in increased cable and main roller life by eliminating grooving of the roller surface and by improving winch spooling. In field tests, a main guide roller 54 using a contoured surface of the invention was found, after considerable use, to have no grooving and the surfaces of the side rollers has less wear than previously and no grooving.

Other aspects, objects and advantages of this invention can be obtained from a study of the drawings, the disclosure and the appended claims.

We claim:

1. A fairlead (26) for a log skidder (10) having a power winch (229, said fairlead (26) having a pair of vertically oriented, spaced apart side rollers (44,46) and a main guide roller (54) extending transverse to said side rollers (44,46), said main guide roller (54) having a pair of side portions (62,62) and a central portion (66) intermediate said side portions (62,62), a shoulder (68) formed on each of said side portions (62,62), each shoulder (68) having a convex section (72) and a concave section (76) merging into each other and extending toward the central portion (66) of said main guide roller (54), said concave section (76) lying tangent to said central portion (66), said main guide roller (54) being of a construction sufficient for urging a cable (32), passing through said fairlead (26) and in contact with one of said side rollers (44,46) from the adjacent shoulder (68) toward the central portion (66) of said main guide roller (54).

2. A fairlead (26) as claimed in claim 1 wherein said central portion (66) of the main guide roller (54) is of uniform diameter between said concave sections (76).

3. A fairlead (26) as claimed in claim 1 wherein said central portion (66) of said main guide roller (54) has a uniform concave contoured surface (80) between said concave sections (76).

4. A fairlead (26) as claimed in claim 1 wherein said concave section (76) of each shoulder (68) has a radius of curvature (R) equal to approximately twice the diameter (D) of the largest cable (32*c*) used on said fairlead (26).

5. A fairlead (26) as claimed in claim 1 wherein each shoulder (68) has an enlarged section (70) of uniform diameter at the outer extremities of said main guide roller (54).

6. A fairlead (26) as claimed in claim 5 wherein said convex section (72) of each shoulder (68) lies tangent to said enlarged section (70) and extends inwardly toward the central portion (66) of said main roller (54).

7. A fairlead (26) as claimed in claim 6 wherein the tangent between said convex section (72) and said enlarged section (70) lies outboard on said main guide roller (54) from the intersection of a plane lying tangent to, and perpendicular to, a radius of one of said side rollers (44,46) which radius is parallel to the longitudinal axis of said main guide roller (54).

8. In a fairlead (26) for a log skidder (10) having a power winch (22), said fairlead (26) having a housing (34) with a pair of side walls (36,38), a top wall (40) and a bottom wall (42), said housing (34) having an opening at the front and the rear thereof, a pair of vertically oriented, spaced apart side rollers (44,46) rotatably mounted on the housing (34) in overlapping relationship to the side walls (36,38) to partially restrict said opening at the front of said housing (34), and an overhead guide roller (50) rotatably mounted on the housing (34) and overlapping the top wall (40) to partially restrict the top part of said opening at the front of said housing (34), in combination: a main guide roller means (54) rotatably mounted between said side walls (36,38), said main guide roller means (54) having a pair of side portions (62,62) and a central portion (66) intermediate said side portions (62,62), a shoulder (68) formed on each of said side portions (62,62), each shoulder (68) having an enlarged portion (70) of a uniform diameter about the axis of the guide roller, each shoulder (68) having a convex rounded section (72) immediately contiguous to and lying tangent to said enlarged portion (70), said convex rounded section (72) extending toward the central portion (66) of said main guide roller (54), each shoulder (68) having a concave rounded section (76) immediately contiguous to and merging with said convex rounded section (72), said concave rounded section (76) extending toward said central portion (66) of said main guide roller (54), each said concave rounded section (76) lying tangent to said central portion (66), a portion of each said convex rounded section (72) of each shoulder (68) extending outwardly beyond the intersection of a plane with said main guide roller (54) which plane lies tangent to an adjacent side roller and is perpendicular to a radius of said side roller which radius is parallel to the axis of said main guide roller (54).

9. In a fairlead (26) as claimed in claim 8 wherein said central portion (66) of the main guide roller means (54) is of uniform diameter between said tangents with said two concave rounded sections (76) of said shoulders (68).

10. In a fairlead (26) as claimed in claim 8 wherein said central portion (66) of said main guide roller means (54) has a uniform concave contoured surface (80) extending between said tangents with said two concave rounded sections (76) of said shoulders (68).

11. In a fairlead (26) as claimed in claim 8 wherein said concave rounded section (76) of each shoulder (68) has a radius of curvature (R) equal to approximately twice the diameter (D) of the largest cable (32*c*) used on said fairlead (26).

12. In a fairlead (26) as claimed in claim 10 wherein said concave contoured surface (80) of the central portion (66) has a radius of curvature (T) several times the radius of curvature of the concave rounded sections (76) of the shoulders (68).

13. In a fairlead (26) as claimed in claim 12 wherein said radius of curvature (T) of said central portion (66) is equal to approximately eighteen inches.

14. In a fairlead (26) as claimed in claim 12 wherein said radius of curvature (R) of said concave rounded section (76) of each shoulder (68) is equal to approximately two inches.

* * * * *